United States Patent [19]

Schwartz et al.

[11] 4,268,546

[45] May 19, 1981

[54] METHOD OF MAKING NON-WOVEN FABRICS FROM SYNTHETIC FIBERS

[75] Inventors: James E. Schwartz; Kent B. McReynolds, both of Midland, Mich.

[73] Assignee: The Dow Chemical Company, Midland, Mich.

[21] Appl. No.: 162,708

[22] Filed: Jun. 25, 1980

Related U.S. Application Data

[63] Continuation of Ser. No. 4,418, Jan. 18, 1979, abandoned.

[51] Int. Cl.[3] ..... B05D 3/02

[52] U.S. Cl. ..... 427/393.5; 260/29.6 RW; 260/29.6 T; 260/29.7 UA; 427/389.9; 427/392; 427/393; 428/290

[58] Field of Search ..... 427/389.9, 393.5, 392, 427/393; 428/224, 283, 286, 288, 290, 480, 481, 482; 260/29.6 RW, 29.6 T, 2.7 UA, 29.7 R; 128/516, 517, 290 P, 290 B, 296; 55/323, 524

[56] References Cited

U.S. PATENT DOCUMENTS

| | | | |
|---|---|---|---|
| 2,976,167 | 3/1961 | Maeder et al. . | |
| 3,142,654 | 7/1964 | Peterson | 260/29.7 R |
| 3,202,638 | 8/1965 | Van Ess . | |
| 3,256,234 | 6/1966 | Miller | 260/29.7 |
| 3,397,165 | 8/1968 | Goodman et al. | 260/29.7 |
| 3,720,562 | 3/1973 | Drelich | 156/291 |
| 3,784,401 | 1/1974 | Wheelock | 34/36 X |
| 3,920,868 | 11/1975 | Hammer et al. | 427/354 |
| 3,944,690 | 3/1976 | Distler et al. | 427/390 |
| 4,176,108 | 11/1979 | Caimi et al. | 260/29.6 TA |

FOREIGN PATENT DOCUMENTS

| | | |
|---|---|---|
| 46-16897 | 5/1971 | Japan . |

*Primary Examiner*—Ronald H. Smith
*Assistant Examiner*—Thurman K. Page

[57] ABSTRACT

Non-woven fabrics are prepared from synthetic fibers by impregnating the fibers with a liquid binder system containing a polymer of from 35 to 60 weight percent of a hard monomer, 0 to 45 weight percent of butadiene or isoprene, 10 to 50 weight percent of an acrylate having from 1 to 8 carbon atoms in the ester portion and 1 to 5 weight percent of an ethylenically unsaturated mono- or dicarboxylic acid.

5 Claims, No Drawings

METHOD OF MAKING NON-WOVEN FABRICS FROM SYNTHETIC FIBERS

CROSS-REFERENCE TO RELATED APPLICATION

This is a continuation of application Ser. No. 004,418 filed Jan. 18, 1979 now abandoned.

BACKGROUND OF THE INVENTION

Synthetic fibers and mixtures of synthetic and natural fibers are bound together with various latexes to produce non-woven fabrics as shown, for example, in U.S. Pat. Nos. 3,256,234; 3,720,562; 3,769,067; 3,784,401; 3,920,868; and 4,001,163. While styrene-butadiene latexes are very economical in this use, such latexes have, historically, failed to compete in this market largely because of poor stability to heat and light and, in some cases, insufficient wet tensile strength. Hitherto, it has been difficult to obtain non-woven fabrics having both desirable strength characteristics and a soft, cloth-like feel from synthetic fibers.

SUMMARY OF THE INVENTION

We have now found that non-woven fabrics having excellent wet strength, stability to heat and light and a desirable cloth-like feel may be prepared by impregnating synthetic fibers with a liquid binder system containing a polymer, the solids of which comprise from about 35 to 60 weight percent of a hard monomer, about 0 to 45 weight percent of butadiene or isoprene, about 10 to 50 weight percent of an acrylate ester having from 1 to 8 carbon atoms in the ester portion and about 1 to 5 weight percent of an ethylenically unsaturated mono- or dicarboxylic acid.

DETAILED DESCRIPTION OF THE INVENTION

The non-woven fabrics prepared by the method of this invention, in addition to having excellent wet strength and stability to heat and light, have a cloth-like feel and are admirably suited for use in products such as diapers and inner liners for various articles of clothing.

The hard monomer to be employed may be, for example, styrene, acrylonitrile or methyl methacrylate, with styrene being preferred. Advantageously, the hard monomer is employed in an amount of from 40 to 45 weight percent of the polymer solids. When acrylonitrile is employed as all or a portion of the hard monomer, the resulting products are advantageously employed in non-skin contact applications such as oil or air filters or as dimensional stabilizers in road construction.

The soft portion of the polymer solids advantageously comprises butadiene and butyl acrylate. Butadiene is preferably present in an amount of from about 20 to 40 weight percent, most advantageously, about 32 to 38 weight percent. The acrylate portion of the polymeric solids preferably amounts to about 15 to 35 weight percent of such solids, and most preferably comprises about 15 to 25 weight percent of such solids.

The unsaturated carboxylic acid is preferably employed in an amount of from 2 to 4 weight percent, solids basis. Below 2 weight percent, the dispersion is less stable. Above 4 weight percent, the product has reduced heat stability. While monocarboxylic acids such as acrylic and methacrylic acid may be employed, the preferred acids are dicarboxylic acids such as, for example, itaconic and fumaric acid.

The latexes employed in this invention may be prepared by known procedures for polymerization in aqueous emulsion. Typically, the monomers are dispersed in an aqueous solution of from about 0.05 to 5 percent of a polymerization catalyst, such as potassium persulfate, and from about 0.05 to 5 percent of a pH stable surface-active agent capable of emulsifying the monomers as known in the art. Polymerization is initiated by heating the emulsified mixture, usually between 60° and 100° C. and is continued by maintaining the polymerizing emulsion at the desired temperature. After the polymerization has reached the desired conversion of monomer to polymer, the latex is filtered to remove any precoagulum and may be stabilized to storage by the addition of a small amount of known antioxidant. A preferred method is that disclosed in U.S. Pat. No. 3,563,946. In the preparation of the polymer, chain transfer agents such as $CCl_4$, bromoform and alkyl mercaptans are advantageously employed. The resulting polymer is a soft, tacky polymer having a glass transition temperature (Tg) of from about +10° C. to −40° C.

The latex is compoundable with known additives in the non-woven industry such as, for example, melamine-formaldehyde resins for improvement in water, detergent and solvent resistance, flame-retardant additives, anionic or nonionic surfactants, heat and light stabilizers and fillers.

The method of this invention may be employed with a wide variety of synthetic fibers such as, for example, polyester, polypropylene and nylon and mixtures of such fibers with natural fiber such as rayon and wood pulp. The procedural steps and apparatus commonly employed in the art may be employed in the method of this invention. Some of these procedures are set out in the prior art referred to in the Background of the Invention.

The invention is further illustrated by the following examples in which all parts are by weight unless otherwise indicated. In the examples, the non-woven webs were placed between two pieces of cotton gauze scrim and the scrim/fiber sandwich was immersed in the latex bath and immediately fed through a squeeze roll saturator. The polymer pickup was controlled by adjusting the percent solids of the latex and the pressure on the rollers.

EXAMPLE 1

A latex (about 50% solids) was prepared from the following recipe:

Styrene: 42.5 parts
Butadiene: 35.0 parts
Butyl Acrylate: 20.0 parts
Itaconic Acid: 2.50 parts
Carbon Tetrachloride: 5.0 parts
Anionic Surfactant: 1.0 part
Sodium Persulfate: 0.8 part The latex was stabilized by the addition of:

Antioxidant: 2.0 parts
Diammonium Phosphate: 0.25 part
Chelating Agent: 0.50 part
$NH_4OH$ to pH: 8–8.5

The above latex was saturated on a polyester non-woven web (4×14") having a density of 1 ½ ounces per square yard at 20% polymer pickup, air dried, then cured at 300° F. for 3 minutes. The properties in the cross machine direction of the resulting fabric were:

Dry Tensile: 5.2 lbs/in
% Elongation: 63
Wet Tensile: 3.4 lbs/in
Wet % Elongation: 58
% W/D Tensile: 65

This fabric had a soft, cloth-like feel and excellent stability to heat and light.

EXAMPLE 2

Following the above procedures, a latex (Ca 50% solids) was prepared from the following recipe and tested as before:

Styrene: 37.5 parts
Butadiene: 40.0 parts
Ethyl Acrylate: 20.0 parts
Itaconic Acid: 2.5 parts
Carbon Tetrachloride: 4.0 parts
Anionic Surfactant: 0.75 part
Sodium Persulfate: 0.8 part The latex was stabilized by the addition of:

Antioxidant: 1.5 parts
Diammonium phosphate: 0.25 part
Chelating Agent: 0.50 part
$NH_4OH$ to pH: 8–8.5

The results of testing a non-woven polyester fabric prepared as in Example 1 were:

Dry Tensile: 5.5 lbs/in
% Elongation: 63
Wet Tensile: 2.8 lbs/in
Wet % Elongation: 57
% W/D Tensile: 51

This fabric had a soft, cloth-like feel and good stability to heat and light.

EXAMPLE 3

Following the above procedures, a latex (Ca 50% solids) was prepared from the following recipe and tested as before:

Styrene: 48.0 parts
Butadiene: 30.0 parts
2-Ethylhexyl Acrylate: 20.0 parts
Itaconic Acid: 2.0 parts
Carbon Tetrachloride: 10.0 parts
Anionic Surfactant: 0.75 part
Sodium Persulfate: 0.8 part The latex was stabilized by the addition of:

Antioxidant: 1.5 parts
Diammonium Phosphate: 0.25 part
Chelating Agent: 0.50 part
$NH_4OH$ to pH: 8–8.5

The results of testing a non-woven polyester fabric prepared as in Example 1 (pickup 25%) were:

Dry Tensile: 6.3 lbs/in
% Elongation: 49
Wet Tensile: 4.7 lbs/in
% W/D Tensile: 75

This fabric had a soft, cloth-like feel and good stability to heat and light.

We claim:

1. A method for making non-woven fabrics having a soft, cloth-like feel from synthetic fibers in which a polymer in the form of an aqueous dispersion is incorporated into a web of synthetic fibers, water is removed and the retained polymeric binder is cured which comprises impregnating the synthetic fibers with an aqueous binder system containing a polymer, the solids of which consist essentially of from 35 to 60 weight percent of a hard monomer, 0 to 45 weight percent of butadiene or isoprene, 10 to 50 weight percent of an acrylate ester having from 1 to 8 carbon atoms in the ester portion and 1 to 5 weight percent of an ethylenically unsaturated mono- or dicarboxylic acid.

2. Method of claim 1 wherein the hard monomer is styrene.

3. Method of claim 2 wherein the binder comprises from about 40 to 45 weight percent styrene, about 20 to 40 weight percent butadiene, about 15 to 35 weight percent butyl acrylate and about 2 to 4 weight percent itaconic acid.

4. Method of claim 3 wherein the synthetic fiber is a polyester.

5. Method of claim 3 wherein the synthetic fiber is polypropylene.

* * * * *